United States Patent [19]

Nakamura et al.

[11] Patent Number: 4,740,143

[45] Date of Patent: Apr. 26, 1988

[54] SCROLL-TYPE FLUID TRANSFERRING MACHINE WITH GAP ADJUSTMENT BETWEEN SCROLL MEMBERS

[75] Inventors: Toshiyuki Nakamura; Tsutomu Inaba; Yasuyuki Suzuki; Norihide Kobayashi, all of Wakayama, Japan

[73] Assignee: Mitsubishi Denki Kabushiki Kaisha, Tokyo, Japan

[21] Appl. No.: 855,675

[22] Filed: Apr. 25, 1986

[30] Foreign Application Priority Data

May 16, 1985 [JP] Japan ..... 60-106306
May 16, 1985 [JP] Japan ..... 60-106308
May 17, 1985 [JP] Japan ..... 60-106501

[51] Int. Cl.[4] ..... F01C 1/04; F01C 19/08

[52] U.S. Cl. ..... 418/55; 418/142; 277/204

[58] Field of Search ..... 418/55, 142; 277/204

[56] References Cited

U.S. PATENT DOCUMENTS 801,182 10/1905 Creux ..... 418/55
3,994,636 11/1976 McCullough et al. ..... 418/55
4,199,308 4/1980 McCullough ..... 418/55
4,437,820 3/1984 Terauchi et al. ..... 418/142

FOREIGN PATENT DOCUMENTS 0065261 11/1982 European Pat. Off. ..... 418/55
3140512 4/1983 Fed. Rep. of Germany .
59-176484 10/1984 Japan ..... 418/55
59-176485 10/1984 Japan ..... 418/142

*Primary Examiner*—John J. Vrablik
*Attorney, Agent, or Firm*—Oblon, Fisher, Spivak, McClelland & Maier

[57] ABSTRACT

A scroll-type fluid transferring machine has stationary and oscillatable scroll members, each being provided with a base plate and a wrap plate projecting from a surface of the base plate, which are combined in such a manner that a plurality of compression chambers are formed by the surfaces of the base plates and wrap plates and a fluid contained in the chambers is transferred, compressed or expanded by the revolution of the oscillatable scroll member. The scroll-type fluid transferring machine comprises a first fine adjustment element having the same spiral form as the wrap plate of the stationary scroll member; a second fine adjustment element having the same spiral form as the wrap plate of the oscillatable scroll member; a first guide groove having the same spiral form as the first fine adjustment element and being formed in the top end surface of the wrap plate of the stationary scroll member; a second guide groove having the same spiral form as the second fine adjustment element and being formed in the top end surface of the wrap plate of the oscillatable scroll member, wherein the first and second fine adjustment elements are respectively received in the first and second guide grooves so that gaps between the end surface of the wrap plates and the surface of the base plates facing the wrap plates are finely adjusted.

2 Claims, 16 Drawing Sheets

FIGURE 5
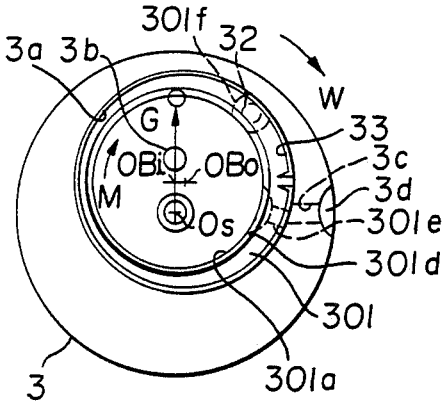
FIGURE 7
FIGURE 6
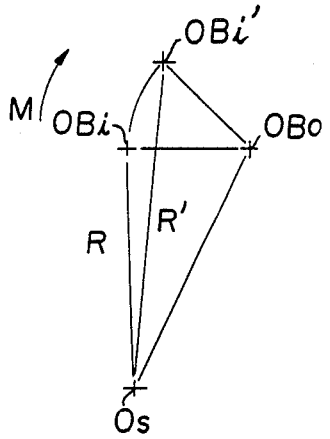
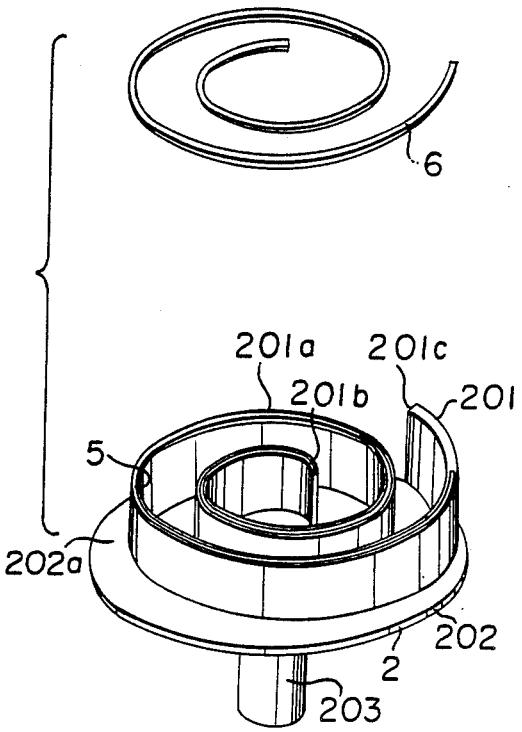

FIGURE 29(a)
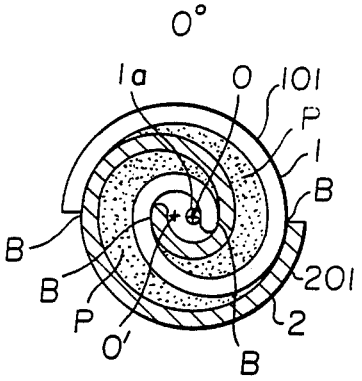
FIGURE 29(d)
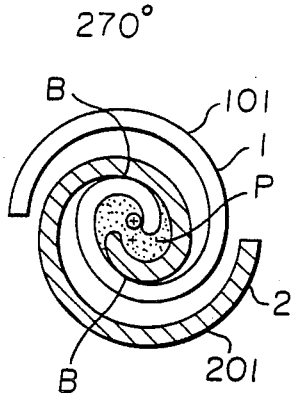
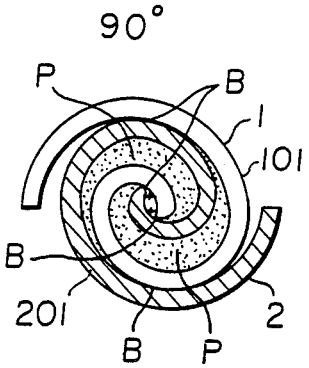
FIGURE 29(b)
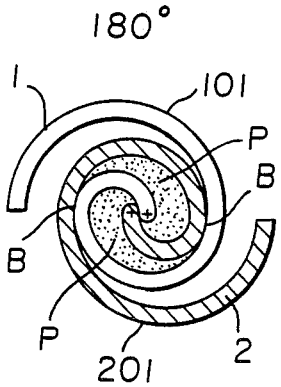
FIGURE 29(c)

SCROLL-TYPE FLUID TRANSFERRING MACHINE WITH GAP ADJUSTMENT BETWEEN SCROLL MEMBERS

BACKGROUND OF THE INVENTION

1. Field Of The Invention The present invention relates to a scroll-type fluid transferring machine. More particularly, it relates to a fine adjustment structure of a gap in a scroll type fluid transferring machine used for a compressing machine such as an air compressor or a refrigerant compressor, a pump, an expansion machine and so on.

2. Description Of Prior Art

The principle of the scroll-type fluid transferring machine has been known long ago and application of the machine to various apparatuses such as compressors, pumps, expansion machines has been studied.

FIG. 29 are diagrams showing a basic construction of a scroll-type fluid transferring machine. In FIG. 29, a reference numeral 1 designates a stationary scroll member, a numeral 2 an oscillatable scroll member, a numeral 1*a* an outlet port, a symbol P a compression chamber, a symbol O the center of the stationary scroll member, a symbol O' the center of the oscillatable scroll member 2. The stationary and oscillatable scroll members 1, 2 respectively have a spiral wrap plate 101 or 201 on each base plate in one piece. The wrap plates 101, 201 have the same shape but has the inverse direction of winding. The wrap plates 101, 201 of the stationary and oscillatable scroll members 1, 2 are combined with each other as shown in FIG. 29 so that the side surfaces of the plates are brought to contact with each other at a point B. The shape of the wrap plates 101, 201 is constituted by an involute curve or the combination of other suitable curves.

The operation of the scroll-type fluid transferring machine when operated as a compressor will be described.

In FIG. 29, the stationary scroll member 1 is kept stationary and the oscillatable scroll member 2 is combined with the stationary scroll member 1 to be subjected to oscillating movement without changing its posture in the space. FIG. 29 shows each state of the stationary and oscillatable scroll members 1, 2 at angle positions of 0°, 90°, 180° and 270°. As the oscillatable scroll member 2 moves, the point of contact B moves toward the center whereby gas confined in a crescent-shaped compression chamber P formed between the wrap plate 101 of the stationary scroll member and the wrap plate 201 of the oscillatable scroll member is gradually compressed and is finally discharged through the outlet port 1*a*. In this case, the distance between the centers O and O' is kept constant (FIG. 29). Namely, $OO'=Z/2-t$ wherein the distance between the wrap plates 101, 201 is Z and the thickness of the wrap plates is t. The distance Z corresponds to the pitch between the wrap plates 101, 201. In FIG. 29, when the oscillatable scroll member 2 is oscillated in the reverse direction, the scroll-type fluid transferring machine functions as an expansion machine.

Now, a concrete construction of the scroll-type fluid transferring machine operating according to the above-mentioned principle will be described with reference to FIG. 30. FIG. 30 shows a conventional scroll-type fluid transferring machine applied to a compressor. In FIG. 30, the same reference numerals as in FIG. 29 designate the same or corresponding parts. Reference numerals 102 and 202 respectively designate the base plates of the stationary and oscillatable scroll members 1, 2, symbols A designate gaps in the axial direction formed between the end surface 101*a* of the wrap plate 101 and the bottom surface 202*a* of the base plate 202 and between the end surface 201*a* of the wrap plate 201 and the bottom surface 102*a* of the base plate 102.

The oscillatable scroll member 2 is combined with the stationary scroll member 1 so that a surface of the base plate 202 which is opposite the surface having the wrap plate 201 is supported by a frame 4. The stationary scroll member 1 is fixed to the frame 4.

When a main shaft 3 is rotated as shown by the arrow mark, the oscillatable scroll member 2 engaged therewith commences its operation. In this case, the oscillatable scroll member 2 is subjected to revolution around its center without rotation around its center by means of a rotation preventing device though it is not shown in the Figure. As a result, a fluid to be compressed is sucked through an intake port 1*b* and the fluid compressed according to the principle of operation shown in FIG. 29 is discharged through the outlet port 1*a*.

In the fluid transferring machine, an amount of the fluid leaked through the gaps A in the radial direction of the wrap plates is relatively large in comparison with the volume of the fluid taken in the compression chamber since the length of the portions where leakage occurs corresponds to the length in the longitudinal direction of the wrap plate on the assumption that the wrap plate is developed. Thus, the leakage of the fluid largely influences efficiency of operation of the fluid transferring machine.

As a method of providing sealing in the radial direction of the wrap plate spirally wound, there is considered means to minimize the gaps as disclosed, for instance, in Japanese Unexamined Patent Publication No. 46081/1980. Namely, leakage of the fluid to be compressed is prevented by introducing oil together with the fluid to be compressed through the intake port 1*b* so that an oil film is formed in the minute gaps A. However, in order to form such minute gaps uniformly, high accuracy in dimensions of the stationary and oscillatable scroll members 1, 2, the frame 4 and other elements is required. There are problems in machining and assembling operations. For instance, in some case, selective fitting of parts is required in the assembling operations.

During the operations of the machine, the outlet port la and the neighboring portions are heated by the compressed fluid with the consequence that if there is caused thermal expansion beyond the distance of the minute gaps A at any local portion, there takes place undesired mechanical friction. To avoid such phenomenon, it is necessary to broaden the gaps A taking consideration of the quantity of thermal expansion. However, this does not provide the optimum gaps required to form an effective oil film with the result that leakage of the fluid becomes large to deteriorate the sealing effect.

Besides such a non-contact sealing method, there is another proposal of preventing leakage of the fluid. Namely, a groove is formed in the end surface of the wrap plate 101 or 201 in its longitudinal direction of the wrap, and a sealing material is fitted in the groove thereby providing a contact sealing means. Such a sealing method is formerly disclosed in U.S. Pat. No. 801182 in 1905, and is recently disclosed in Japanese Unexamined Patent Publication No. 117304/1976.

The sealing means disclosed in Japanese Unexamined Patent Publication No. 117304/1976 will be described as an example with reference to FIGS. 31 to 34.

FIG. 31 is an enlarged cross-sectional view showing a gap A and its neighboring portion formed between the bottom surface 102*a* of the stationary scroll member 1 and the end surface 201*a* of the wrap plate 201 of the oscillatable scroll member 2. A groove 5 of a rectangular shape in cross-section is formed in the end surface 201*a* of the wrap plate 201 so as to open along the longitudinal direction of the wrap plate. A sealing member 51 having the analogous shape to the groove 5 is fitted in the groove 5. Dimensions of the groove 5 and the sealing member 51 are so determined that a first gap 501 is formed between the first side surface 5*b* of the groove 5 and the first side surface 51*b* of the sealing member 51 along the longitudinal direction of the wrap plate, and a second gap 502 is formed between the bottom surface 5*d* of the groove 5 and the lower surface 51*d* of the sealing member 51. Accordingly, a gas flowing from a high pressure side compression chamber $P_H$ to a low pressure side compression chamber $P_L$ is passed through the first and second gaps 501, 502 as indicated by the solid arrow marks to exert a force in the direction indicated by F. The upper surface 51*a* of the sealing member is urged to the bottom surface 102 of the base plate and the second side surface 51*c* of the sealing member 51 is urged to the second side surface 5*c* of the groove 5 to prevent leakge of the gas, even though there exists the gap A between the end surface 201*a* of the wrap plate 201 and the bottom surface 102*a* of the base plate. Although such sealing method is effective for the leakage of the gas in the direction along the wrap plate, leakage of the gas easily takes place in the longitudinal direction of the wrap plate through the first and second gaps 501, 502 between the high and low compression chambers $P_H$ and $P_L$ which is partitioned at the point of contact B by the wrap plates 101, 201.

The disadvantage of the above-mentioned method will be described in detail with reference to FIGS. 32 and 33. FIG. 32 is a partly cross-sectioned plane view showing the area of the point of contact B between the wrap plates 101, 201, and FIG. 33 is a perspective view partly cross-sectioned.

FIG. 32 shows that the gas leaks to the low pressure side compression chamber $P_L$ at the downstream side of the high pressure side compression chamber $P_H$ through the first and second gaps 501, 502 as shown by the solid arrow marks. In this method, although sealing function in the radial direction of the wrap plate is effective, the leakage of the gas in the longitudinal direction of the wrap plate unavoidably occurs since the first and second gaps 501, 502 are formed between the groove 5 and the sealing member 51; thus, reduction in compression efficiency or performance is unavoidable. Particularly, scattering in dimensions of the first and second gaps 501, 502 possibly increases leakage of the gas passing through the gaps 501, 502 and the leakage of the gas in the radial direction of the wrap plate due to reduction in ability of following-up of the sealing member 51. Further, loss of the sliding movement and wearing of the upper surface 51*a* of the sealing member 51 are not negligible because the upper surface 51*a* is pushed at the bottom surface 102*a* during the sliding movement.

As means for preventing leakage of the gas in the longitudinal direction of the wrap plate, there is a proposal in Japanese Unexamined Utility Model Publication NO. 180182/1982. Namely, as shown in FIG. 34, the width D of the sealing member 51 is substantially equal to the width D′ of the groove 5, and the thickness H of the sealing member 51 is made greater than the depth H′ of the groove 5. However, it is difficult to control the dimensions H and H′. If $H-H'>A$, the gap in the axial direction of the scroll members becomes large to thereby increase in an amount of the gas leaked in the radial direction of the scroll members. If $H-H'<A$, the gap A is too small whereby smooth rotation can not be obtained.

Thus, in the conventional scroll-type fluid transferring machine of the non-contact sealing type, if a uniform minute gap is to be formed in the axial direction, there is the problem of controlling accuracy in dimension of the scroll members to be finished. Further, if the gap is to be narrowed, there is the problem that the end surface of the wrap plates come in contact with the bottom surface due to thermal expansion during the operation of the machine to thereby cause frictional heating. If the gap is broaden to prevent the friction performance of the fluid transferring machine is reduced. Thus, there is contradiction.

In the conventional scroll-type fluid transferring machine of the contact sealing type, there is the problem of reduction in performance caused by the leakage of the gas through the gap and the wearing of the sealing member when the first and second gaps are formed between the sealing member and the groove so that the sealing member is pushed by the pressure of the gas. Further, when the sealing member is used without forming any gap between the sealing member and the groove, severe requirement of accurate dimensions is required as in the non-contact sealing type.

SUMMARY OF THE INVENTION

It is an object of the present invention to provide a fine adjustment structure of a gap in a scroll-type fluid transferring machine which has a simple structure; is easily assembled; accommodates errors of the dimensions and deformation due to heat during the operation; and prevents leakage of the gas effectively.

The foregoing and the other objects of the present invention have been attained by providing a scroll-type fluid transferring machine having stationary and oscillatable scroll members, each being provided with a base plate and a wrap plate projecting from a surface of the base plate, which are combined in such a manner that a plurality of chambers are formed by the surface of the base plates and wrap plates, and a fluid contained in the chambers is transferred, compressed or expanded by the revolution of the oscillatable scroll member, characterized by comprising a first fine adjustment element having the same spiral form as the wrap plate of the stationary scroll member; a second fine adjustment element having the same spiral form as the wrap plate of the oscillatable scroll member; a first guide groove having the same spiral form as the first fine adjustment element and being formed in the top end surface of the wrap plate of the stationary scroll member; a second guide groove having the same spiral form as the second fine adjustment element and being formed in the top end surface of the wrap plate of the oscillatable scroll member, wherein the first and second fine adjustment elements are respectively received in the first and second guide grooves so that gaps between the end surface of the wrap plates and the surface of the base plates facing the wrap plates are finely adjusted.

BRIEF DESCRIPTION OF THE DRAWING

FIGS. 3*a* to 3*c* and FIGS. 4 to 6 are diagrams showing important elements including an eccentric bush and the operation of these parts according to the present invention;

FIG. 7 is a perspective view in a disassembled state of an oscillatable scroll member of the present invention;

FIG. 28(*b*) is a diagram illustrating balance of forces in the fine adjustment structure in the present invention;

FIG. 29 is a diagram showing the principle of a typical scroll-type fluid transferring machine;

DETAILED DESCRIPTION OF PREFERRED EMBODIMENTS

Figure 1:
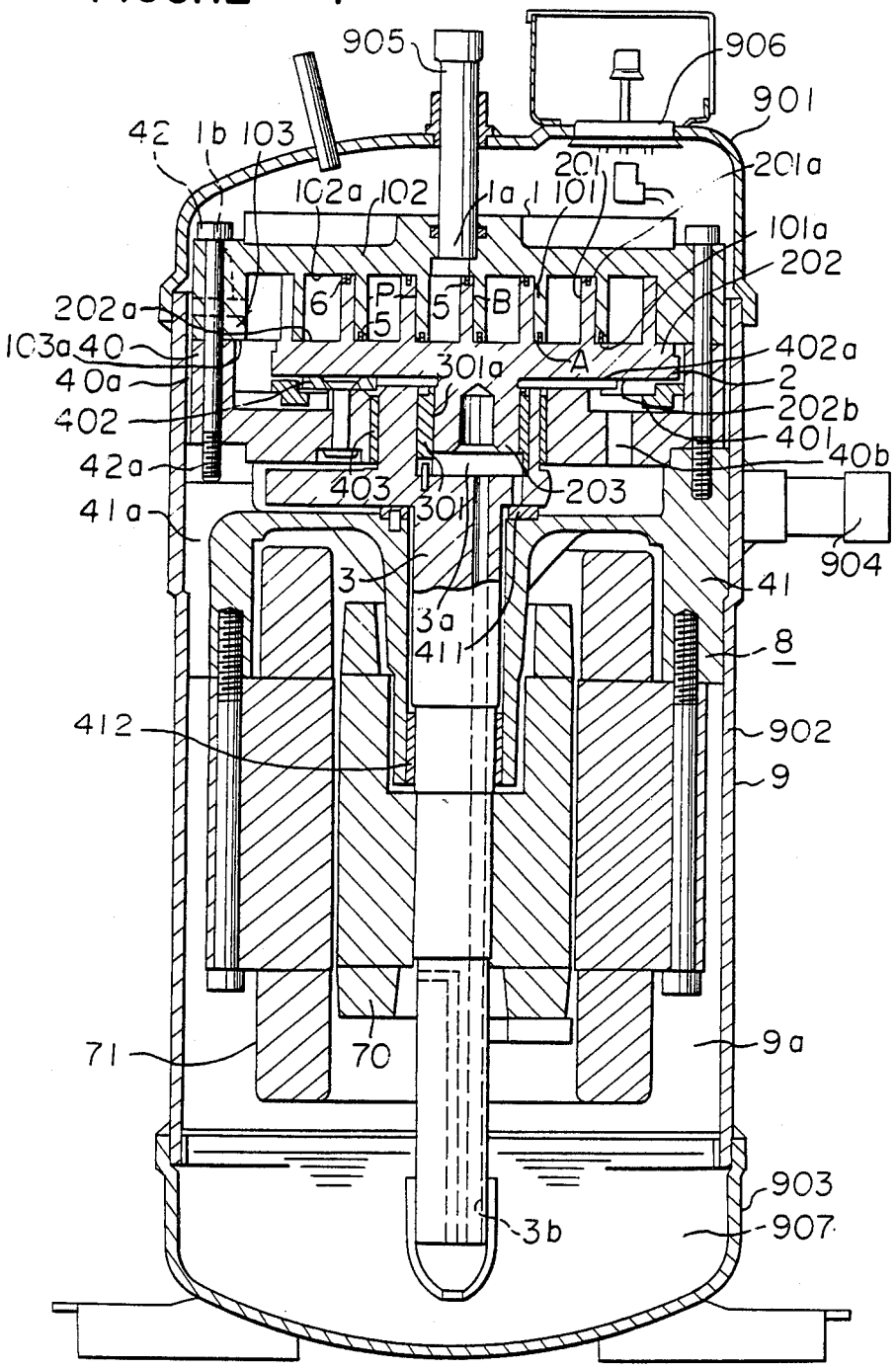
FIG. 1 is a cross-sectional view of an embodiment of the scroll-type fluid transferring machine provided with a sealing and fine adjustment structure.

A first embodiment of the present invention will be described with reference to FIGS. 1 to 15. FIG. 1 shows a practical embodiment of the scroll-type compressor applied to a totally closed type refrigerant compressor.

In FIG. 1, the same reference numerals as in FIGS. 29 to 34 designate the same or corresponding parts. The stationary scroll member 1 has an outer circumferential wall portion 103 in which the intake port lb is formed. A plurality of compression chambers P are formed by means of the base plates 102, 202 and the wrap plates 101, 201. Among the plurality of compression chambers P, a chamber having the highest pressure which is formed near the central portion of the stationary and oscillatable scroll members 1, 2 is brought to be communicated with the outlet port 1*a*.

The groove 5 as a guiding member is formed in the end surface 101*a* or 201*a* of the wrap plate 101 or 201 along the longitudinal direction of the spiral form but remaining areas in which the groove 5 is not formed at the innermost and outermost portion in the wrap plate. A fine adjustment element 6 is fitted in each of the grooves 5. The element 6 is forcibly fitted in the groove 5 so that the element 6 is guided by the groove 5 and both side surfaces of the element 6 is in close-contact with the both inner side surfaces of the groove 5 over the entire region in the longitudinal direction of the groove 5.

A reference numeral 3 designates a main shaft, a numeral 301 designates an eccentric bush which exerts a force to the oscillatable scroll member 2 so that the side surfaces of the wrap plates 101, 201 are always in contact with each other at a point B even though the wrap plates 101, 201 become wear, a numeral 40 designates an upper frame having the substantially same outer circumferential configuration as the stationary scroll member 1 and has the same largest outer diameter as the stationary scroll member 1, a numeral 41 designates a lower frame which has the substantially same outer circumferential configuration as the stationary scroll member 1 and has the largest outer diameter which is greater than that of the upper frame 40, a numeral 401 designates an Oldham's coupling, a numeral 402 designates an upper thrust bearing undergoing pressure of the compression chamber P and the dead weight of the oscillatable scroll member 2, a numeral 411 designates an annular lower thrust bearing undergoing the dead weight of the main shaft 3 and a thrusting force applied to the main shaft by other elements, a numeral 403 an upper main bearing of a material such as a bearing metal whose upper part bears a radial force of the main shaft, and a numeral 412 designates a lower main bearing of a material such as a bearing metal whose intermediate part bears a radial force of the main shaft 3.

At the center of the rear surface 202*b* of the base plate 202 of the oscillatable scroll member 2, a shaft 203 is formed integrally with the rear surface 202*b*. The axis of the shaft 203 is perpendicular to the rear surface 202*b* and is eccentric to the axis of the main shaft 3. An eccentric recess 3*a* having its axis parallel to the axis (the center of rotation) of the main shaft 3 is formed in the upper end portion of the main shaft 3. An eccentric bush 301 is rotatably fitted in the eccentric recess 3*a*. The eccentric bush 301 has an eccentric hole 301*a* which is eccentric to the outer circumference of the bush 301 and the axis of the eccentric hole 301*a* is parallel to the axis of the main shaft 3. The shaft 203 extending from the rear surface 202*b* of the base plate 202 is rotatably fitted into the eccentric recess 301*a*.

The main shaft 3 is supported by the upper main bearing 403 provided in the upper frame 40, the lower thrust bearing 411 provided in the lower frame 41 and the lower main bearing 412. The upper frame 40 and the lower frame 41 are assembled by fitting one to the other by means of annular projection and recess so that the upper main bearing 403 is placed co-axial with the lower main bearing 412. The upper main bearing 403 and the upper thrust bearing 402 have the same axial center, and the axis of the upper main bearing 403 is perpendicular to the bearing surface 402*a* of the upper thrust bearing 402. Accordingly, the axis of the main shaft 3 is in alignment with the axis of the upper thrust bearing 402, and is maintained to be perpendicular to the bearing surface 402*a pl of the upper thrust bearing 402. Further, since the oscillatable scroll member 2 has the rear surface 202b* of the base plate 202 supported by the bearing surface 402*a* of the upper thrust bearing 402, the base plate 202 of the oscillatable scroll member 2 is maintained to be perpendicular to the main shaft 3.

The Oldham's coupling 401 is to prevent the rotation of the oscillatable scroll member 2 and allows only the revolution of the member 2 around the axis of the main shaft 3. The Oldham's coupling 401 is placed between the base plate 202 of the oscillatable scroll member 2 and the upper frame 40.

Figure 2:
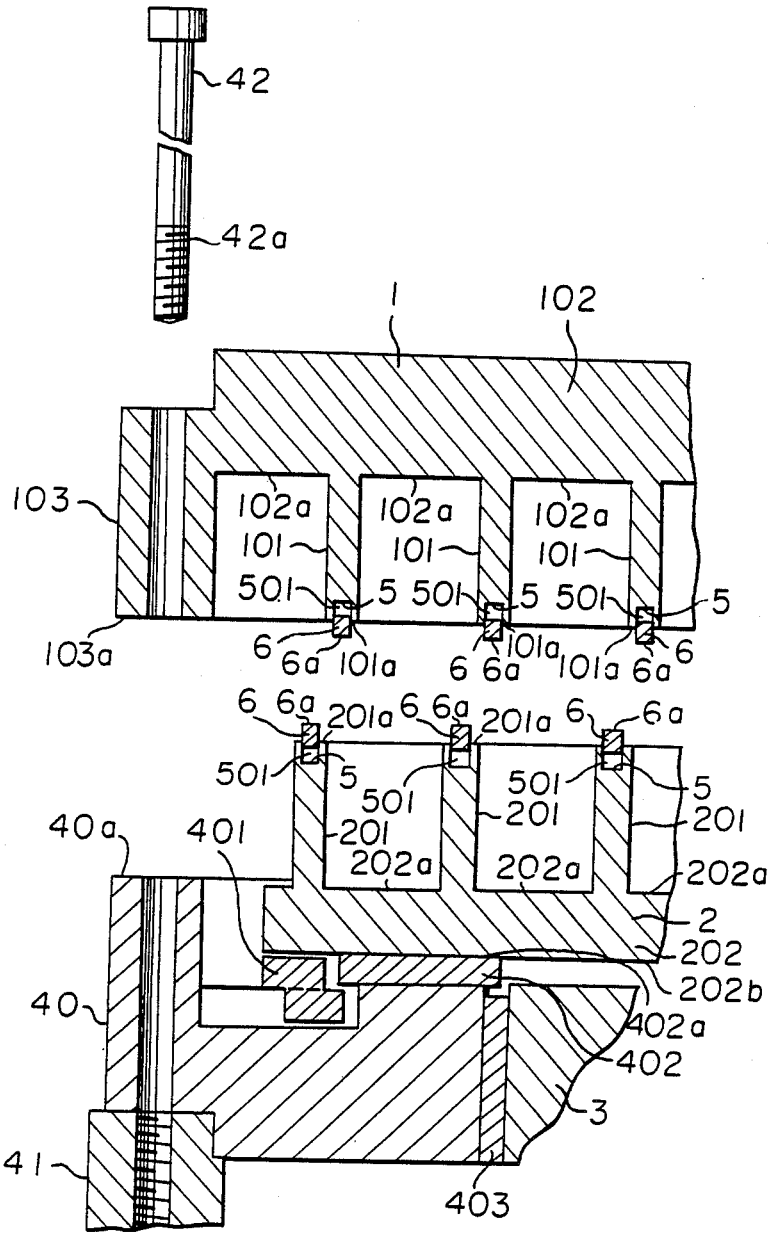
FIG. 2 is an enlarged cross-sectional view partly of an important part of the assembly shown in FIG. 1.

After the elements as above-mentioned are assembled to have a relation as described above, each of the fine adjustment elements 6 is fitted to each groove 5 of the stationary and oscillatable scroll members 1, 2 so that it fairly projects from the groove 5. Then, the upper frame 40, the lower frame 41 and the stationary scroll member 1 are fastened together by means of a plurality of bolts 42 which pass through the outer circumferential wall portion 103 of the stationary scroll member 1 and the upper frame 40 and which are thread-engaged only with the lower frame 41 with their threaded portions 42*a* formed at the end. FIG. 2 shows in detail how to carry out the fastening operation.

The stationary scroll member 1 is fixed to the upper frame 40 with the lower surface 103*a* of the outer circumferential wall portion 103 being in contact with the fitting surface 40*a* which is formed on the upper surface at the outer circumferential part of the upper frame 40. The fitting surface 40*a* of the upper frame 40 is parallel to the bearing surface 402*a* of the upper thrust bearing 402; and the rear surface 202*b* of the base plate 202, the bottom surface 202*a* which is the opposite surface in the oscillatable scroll member 2 and the end surface 201*a* of the wrap plate 201 are formed in parallel with each other. Further, the lower surface 103*a* of the outer circumferential wall portion of the stationary scroll member 1 is formed on the same plane as the end surface 101*a* of the wrap plate 101, and the end surface 101*a* is in parallel to the bottom surface 102*a* of the base plate 102. Accordingly, the end plate 101*a* of the wrap plate of the stationary scroll member 1, the bottom plate 202*a* of the base plate of the oscillatable scroll member 2 are parallel with each other, and end surface 201*a* of the wrap plate of the oscillatable scroll member 2 and the bottom surface 102*a* of the base plate of the stationary scroll member 1 are in parallel with each other Accordingly, each of the elements 6 is pushed by the bottom surface 102*a* of the stationary scroll member 1 or the bottom surface 202*a* of the base plate of the oscillatable scroll member 2 to be uniformly urged in each of the grooves 5.

When the stationary scroll member 1 is fastened to the lower frame 41 by means of the bolts 42, the upper frame 40 being interposed between the stationary scroll member 1 and the lower frame 41, there are formed uniform minute gaps A between each of the end surfaces 101*a* of the wrap plate of the stationary scroll member 1 and the bottom surface 202*a* of the base plate of the oscillatable scroll member 2, and between each of the end surfaces 201*a* of the wrap plate of the oscillatable scroll member 2 and the bottom surface 102*a* of the base plate of the stationary scroll member 1. The extent of projection of each of the elements 6 is determined by the distance of the minute gaps A when the elements 6 are forced into the grooves 5. Accordingly, there remain no substantial space between each of the end surfaces 101*a*, 201*a* of the wrap plates and each of the bottom surfaces 202*a*, 102*a* owing to the elements 6 projecting from the grooves 5.

In FIG. 1, a motor for driving the main shaft 3 is supported by shrinkfitting the rotor 70 of the motor to the main shaft 3. The stator 71 of the motor is fixed to the lower frame 41 by means of, for instance, bolts in which a suitable air gap is maintained between the rotor 70 and the stator 71 by adjusting the distance therebetween. Thus, an assembly 8 constituted by the stationary scroll member 1, the oscillatable scroll member 2, the upper frame 40, the lower frame 41, the main shaft 3, the rotor 70, the stator 71 and so on is held in a shell 9 as a tightly closed container. The shell 9 is divided into three parts, i.e. an upper cover 901, an intermediate cylindrical part 902 and a bottom cover 903. The assembly 8 is fixed to the intermediate cylindrical part 902 with the outer circumference of the lower frame 41 by shrinkfitting, spot-welding or another suitable method. The upper cover 901 and the bottom cover 903 are fitted to both end parts of the intermediate cylindrical part so as to cover the outer circumferential portions of the intermediate cylindrical part 902, the fitting part being sealed by welding.

A reference numeral 904 designates an intake pipe which is connected to the outer circumferential wall of the intermediate cylindrical part by welding and is opened at the inner space 9*a* of the shell 9, a numeral 905 designates a discharge pipe which passes through the central portion of the upper cover 901 and fixed thereto in an airtight fashion and which is extended to be communicated with the outlet port 1*a* of the stationary scroll member 1, a numeral 906 designates an enclosed terminal which is welded to the upper cover 901 and is electrically connected to the motor stator 71 by a lead wire (not shown), and a numeral 907 designates a lubricant oil stored in the bottom portion of the shell 9. The lower end of the main shaft 3 is immersed in the lubricant oil 907. The joint portion of the discharge pipe 905 and the outlet port 1*a* is sealed by means of, for instance, an O-ring. The main shaft 3 is provided with an eccentric oil feeding passage 3*b* extending from the lower end to the eccentric recess 3*a* formed in the upper end portion so that oil is supplied to each of the bearing parts.

The operation of the scroll compressor having the above-mentioned construction will be described.

On actuation of the motor stator 71 through the enclosed terminal 906, a torque is produced in the motor rotor 70 and it rotates with the main shaft 3*a* rotational force of the main shaft 3 is transmitted to the shaft 203 of the oscillatable scroll member 2 through the eccentric bush 301 fitted in the eccentric recess 3*a* of the main shaft 3, whereby the oscillatable scroll member 2 is subjected to the movement of revolution around the axis of the main shaft 3 without causing the movement of rotation by the guidance of the Oldham's coupling 401; thus, a compressing function as described with reference to FIG. 29 is carried out in the compression chamber P.

During the compressing operation in the compression chamber P, the elements 6 fitted in the grooves 5 uniformly project from the end surfaces 101*a*, 201*a* toward the bottom surfaces 202*a*, 102*a* of the base plates so that the minute gaps A are not formed between them. Accordingly, there is no substantial leakage of the compressed refrigerant gas through the minute gaps A in the radial direction of the wrap, namely in the direction from the high pressure compression chamber to the low pressure compression chamber. Further, co-operation of the side surface of the wrap plates 101, 201 causes rotation of the eccentric bush 301 around the shaft 203 of the oscillatable scroll member 2 by an centrifugal force caused by the movement of an eccentric revolution of the scroll member 2 and the quantity of eccentricity of the oscillatable scroll member 2 with respect to the axis of the main shaft 3, whereby the side surface of the wrap plate 101 and the side surface of the wrap plate 201 are brought into contact with each other at the point B. As a result, leakage of the compressed refrigerant gas from the high pressure compression chamber to the low pressure compression chamber, i.e. in the radial direction of the wrap plates 101, 201, can be prevented. Thus, the leakage of the refrigerant gas during the compressing operation can be almost prevented, and highly efficient compressing operation is possible.

In the next place, description will be made as to a flow of the refrigerant gas. The refrigerant gas from an evaporator (not shown) is introduced into the space 9*a* in the shell 9 through the intake pipe 904 to cool the elements of the assembly 8 such as the motor rotor 70, the motor stator 71 and so on. The refrigerant gas is also passed through the intake passage formed at the outer circumferential part of the lower frame 41 and is sucked through the intake port 1*b* to be entered into the compression chamber P. The refrigerant gas is compressed in the compression chamber P to be a high pressure refrigerant gas. Then, the high pressure refrigerant gas is discharged out of the shell 9 through the discharge pipe 905 via the outlet port 1*a* to be introduced into a condenser (not shown).

An oil feeding system of the scroll-type compressor of the present invention is constructed as follows. The lubricant oil 907 stored in the bottom of the shell 9 is introduced into the eccentric oil feeding passage 3*b* due to centrifugal pumping function resulted by the rotation of the main shaft 3. The lubricant oil 907 is supplied to the eccentric bush 301 through the eccentric recess 3*a*. The lubricant oil also lubricates the upper thrust bearing 402, the lower thrust bearing 411, the upper main bearing 403, the lower main bearing 412 and the Oldham's coupling 401 through oil holes and oil grooves (both not shown) formed in the main shaft 3 and the eccentric bush 301. After lubrication of these parts, a part of lubricant oil is sucked into the compression chamber P together with the refrigerant gas to be used for sealing and lubrication of compression elements. The lubricant oil in the compression chamber P is discharged from the discharge pipe 905 and is again returned into the schell 9 through the intake pipe 904 via the condenser and the evaporator (not shown). The remaining part, i.e. the greater part of the lubricant oil is returned to the bottom of the shell 9 through oil returning holes 40*b*, 41*a* formed in the upper frame 40 and the lower frame 41 respectively.

Figure 3:
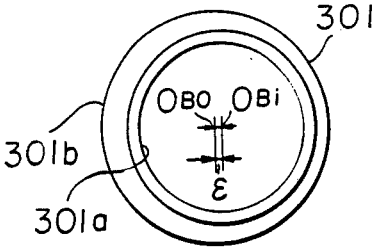
Figure 3:
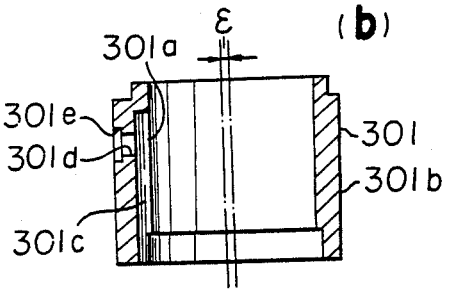
Figure 3:
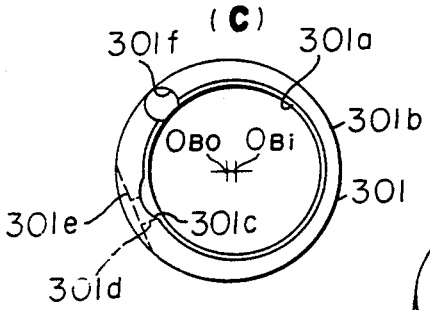

FIG. 3 shows in detail a construction of the eccentric bush 301 to be put in the eccentric recess 3*a* of the main shaft 3, in which FIG. 3*a* is a plane view, FIG. 3*b* is a longitudinal cross-sectional view and FIG. 3*c* is a bottom view.

A reference numeral 301*b* designates an outer circumferential surface of the eccentric bush 301, a symbol $O_{Bo}$ indicates the center of the bush, a numeral 301*a* designates an inner circumferential surface of the eccentric bush, and a symbol $O_{Bi}$ indicates the center of the bush. The center $O_{Bi}$ is deflected by e with respect to the center $O_{Bo}$.

The eccentric bush 301 is provided in its inner circumferential surface 301*a* with an oil groove 301*c* which extends in the vertical direction so that the lower end reaches at the lower end surface of the eccentric bush 301, but its upper end is closed, i.e. the upper end of the oil groove 301*c* does not reach the upper end surface of the eccentric bush 301. An oil hole 301*d* is formed in the eccentric bush so as to communicate the oil groove 301*c* with the outer circumferential surface 301*b* of the bush. A slit 301*e* is formed in the outer circumferential surface 301*b* so that the outer end in the radial direction of the oil hole 301*d* opens in the slit 301*e*. A reference numeral 301*f* designates a rotation-preventing recess which is formed in the lower end surface of a thick-walled portion of the eccentric bush 301. The eccentric bush 301 is made of a bearing material such as aluminum alloy, Pb-Cu-Zn series alloy.

Figure 4:
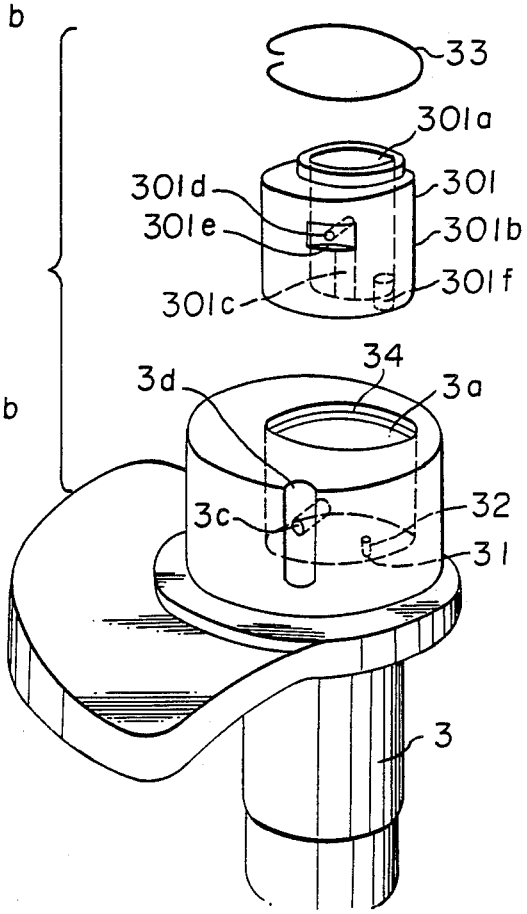

FIG. 4 is a perspective view for showing steps of assembling the eccentric bush 301 to the main shaft 3.

In FIG. 4, a spring pin 32 having a shape of C in plane view and in a substantially cylindrical form is fitted to a pin hole 31 formed in the bottom of the eccentric recess 3*a* of the main shaft 3. Then, the eccentric bush 301 is inserted into the eccentric recess 3*a* so that the rotation-preventing hole 301*f* is engaged with the spring pin 32. Under the condition that the spring pin 32 is fitted to the hole 301*f* and the lower end surface of the eccentric bush 301 is in contact with the bottom of the eccentric bush 3*a*, a snap ring 33 is fitted into a groove 34 formed in the inner circumferential surface of the eccentric recess 3*a*. The snap ring 33 is formed in a shape of C by using a slim resilient wire such as piano wire.

FIG. 5 is a diagram showing the eccentric bush 301 fitted in the eccentric recess 3*a* of the main shaft 3.

In FIG. 5, a symbol $O_S$ indicates the axial center, i.e. the center of the rotation of the main shaft 3. The position of the spring pin 32 is so determined that the center $O_{Bo}$ of the outer circle of the eccentric bush 301 is placed at a position where a linear line extending between the axial center $O_S$ of the main shaft 3 and the center $O_{Bi}$ of the inner circumferential surface 301*a* of the eccentric bush is orthogonally intersects a linear line extending between the center $O_{Bi}$ and the center of the outer circumferential surface 301*b* of the eccentric bush. The rotation-preventing hole 301*f* is made greater than the diameter of the spring pin 32 so that the eccentric bush 301 is somewhat movable in the circumferential direction. Further, the slit 301*e* is formed to have a predetermined length in the circumferential direction so that the oil hole 301*d* of the eccentric bush 301 is always communicated with the oil hole 3*c* formed in the large diameter part of the main shaft 3 in its radial direction. The oil hole 3*c* is communicated with an oil groove 3*d* formed in the outer circumferential surface of the large diameter part of the main shaft 3 in its axial direction.

The shaft 203 of the oscillatable scroll member 2 is fitted in the eccentric bush 301 so that the outer circumferential surface of the shaft 203 is slidably moved with respect to the inner circumferential surface 301*a* of the eccentric bush, whereby the center $O_{Bi}$ of the inner circumferential surface 301*a* of the eccentric bush coincides with the center of oscillation, i.e. the gravity center of the oscillatable scroll member 2. Accordingly, when the main shaft 3 is rotated in the direction of an arrow mark W, a centrifugal force is generated in the direction of an arrow mark G in the linear line extending between the center of rotation $O_S$ of the main shaft and the center $O_{Bi}$ of the inner circumferential surface 301*a* of the eccentric bush whereby a moment is produced in the eccentric bush 301 in the direction of an arrow mark M around the center $O_{Bo}$ of the outer circumferential surface 301*b* of the eccentric bush. Accordingly, when there is a gap between the wrap plates 101, 201, the eccentric bush 301 is turned in the direction of the arrow mark M around the center $O_{Bo}$ of the outer circumferential surface 301*b* of the eccentric bush so as to cause the movement of the oscillatable scroll member 2 until the both wrap plates 101, 201 are mutually contact.

The movement of the center of the eccentric bush 301 will be described with reference to FIG. 6. The eccentric bush 301 is rotated in the direction of the arrow mark M around the center $O_{Bo}$ of the outer circumferential surface 301*b* of the eccentric bush. The center $O_{Bi}$ of the inner circumferential surface 301*a* of the eccentric bush is shifted to a point $O_{Bi'}$ where the wrap plates 101, 201 are mutually contact. Namely, the radius of revolution of the oscillatable scroll member 2 is changed from $\overline{O_S O_{Bi}}=R$ to $\overline{O_S O_{Bi'}}=R'$. Contrally, when the radius of revolution is smaller than R due to admissible error in machining, the eccentric bush is rotated in the direction opposit the arrow mark M. Such rotation of the eccentric bush takes place even when a liquid-back phenomenon or invasion of foreign substance between the wrap plates 101, 201 occurs.

Thus, the eccentric bush 301 accommodates scattering in error in machining operations, allows easily assembling works and increases compression efficiency by preventing the compressed refrigerant gas from leaking in the radial direction of the wrap plates 101, 201 during the compressing operations. Further, the eccentric bush is operable against the liquid-back phenomenon and the invasion of foreign substance to increase reliability of the compressor.

In the next place, detailed and concrete explanation will be made as to a preferred embodiment of the present invention.

FIG. 7 is a perspective view showing a state of assembling operation in which the element 6 is forcibly inserted in the groove 5 formed in the end surface 201*a* of the wrap plate 201 of the oscillatable scroll member 2 in the longitudinal direction of the wrap plate.

The groove 5 has an opening in the end surface 201*a* of the wrap plate 201 in the longitudinal direction of the wrap plate except for the innermost portion 201*b* and outermost portion 201*c* of the end plate 201*a*. The strip-like element 6 is forcibly inserted in the opening of the groove 5 in the vertical direction so as to fill the groove 5. It goes without saying that the element 6 is inserted in the groove 5 of the wrap plate of the stationary scroll member 1 as well. In the following, description will be made as to only the oscillatable scroll member 2.

Figure 8:
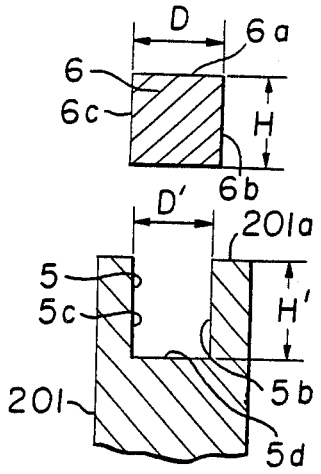
FIGS. 8 to 12 are respectively cross-sectional views showing how the important parts of the present invention are assembled.

FIG. 8 is a cross-sectional view of the grooved wrap plate 201 and the element 6 to be fitted in the groove 5. In FIG. 8, the groove 5 and the element 6 respectively have a rectangular shape in cross-section. The width D of the the element 6 is the same or slightly greater than the width D' of the groove, and the thickness H of the element is the same as or smaller than the depth H' of the groove. If $D>D'$, the element 6 should be of a material elastically deformable or plastically deformable in the direction of width. Accordingly, as the material for the element 6, it is preferably to use polyethylene tetrafluoride (PTFE) having some resiliency and self-lubricating properties. Further, it is preferable to use a soft and plastically deformable metal such as lead, solder or a composite material such as a mixture of PTFE and rubber.

Figure 9:
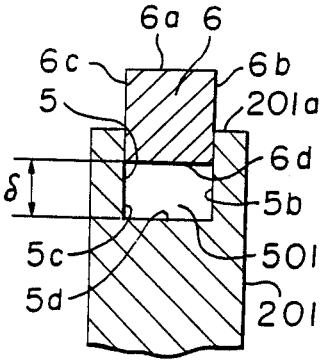

FIG. 9 is a cross-sectional view showing the element 6 put in the groove 5. The element 6 is forcibly inserted in the groove 5 in an elastically deformed (plastically deformed) state in which both side surfaces 6*b*, 6*c* of the element 6 are in close-contact with the both inner side surfaces 5*b*, 5*c* of the groove 5 and the upper portion of the element 6 projects from the end surface 201*a* of the wrap plate. Accordingly, the element 6 is forcibly put in the groove 5 remaining an air gap 501 between the lower surface 6*d* of the element 6 and the bottom surface 5*d* of the groove 5. The dimension of the air gap 501 in the axial direction of the main shaft is given as $\delta$.

Figure 10:
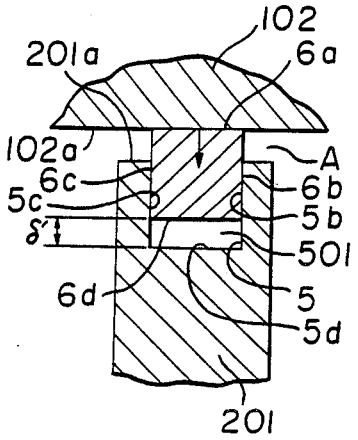

FIG. 10 is a cross-sectional view showing the oscillatable scroll member 2 assembled with the stationary scroll member 1 as explained with reference to FIG. 2.

When the stationary and oscillatable scroll members are assembled, the element projecting from the end surface 201*a* of the wrap plate is pushed downwardly in the groove 5, as shown by an arrow mark, by the bottom surface 102*a* of the stationary scroll member 1. The downward movement of the element is stopped at a position where the minute gap A as described with reference to FIG. 1 is produced between the end surface 201*a* of the wrap plate and the bottom surface 102*a* of the base plate. In this case, there is naturally provided a relation of the dimension $\delta'$ in the axial direction of the air gap 501 $<$the dimension $\delta$ of the air gap 501 in a state before a downward force is applied to the element 6. The dimension $\delta'$ is so determined as to function as an escaping portion so that change in the dimension of the minute gap A caused due to thermal expansion can be absorbed. Such change in dimension is caused when the central portion of the scroll members is heated at a high temperature during the operation of the compressor. Then, a portion of the each of the wrap plate near the central part of the scroll members locally elongates in the axial direction due to thermal expansion whereby the dimension of the minute gap A is locally reduced. Then, a downward force is locally applied to the element 6 by the bottom surface of the base plate with the result that the element 6 is further depressed in the groove 5.

Figure 11:
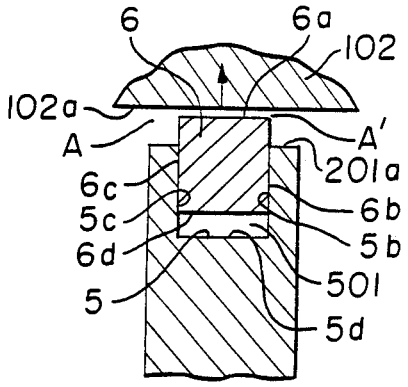

If an elastic force is applied to the element 6 in the axial direction, hence, the bottom surface 102*a* of the base plate is subjected to a repulsive force of the element 6 in the state of FIG. 10, the base plate 102 is returned in the direction of an arrow mark as shown in FIG. 11 to keep a predetermined minute gap A' between the upper surface 6*a* of the element 6 and the bottom surface 102*a* of the base plate.

Figure 12:
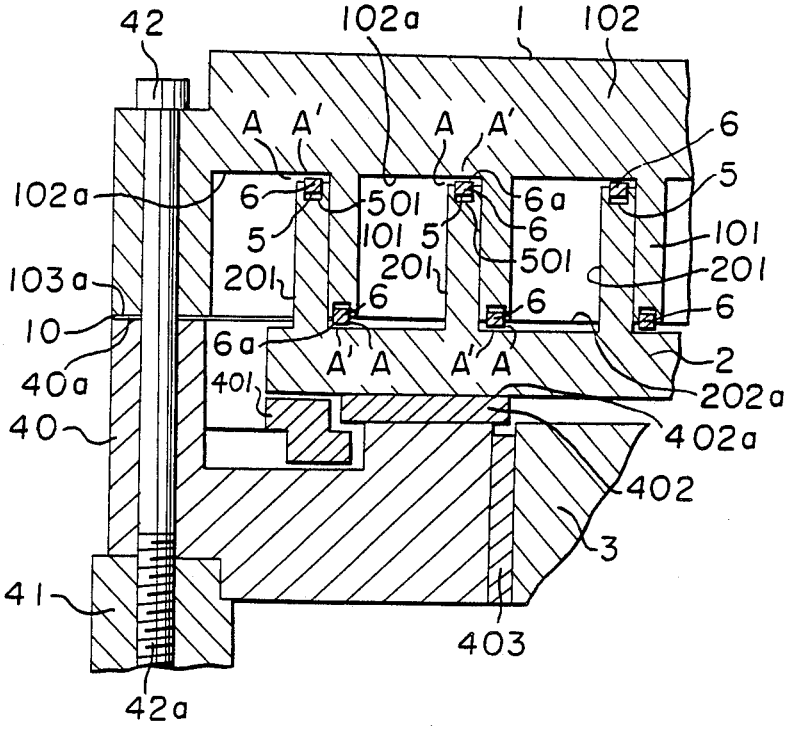

A method for adjusting of the minute gap A' will be described with reference to FIG. 12. In the assembly as shown in FIG. 1, the bolt 42 are removed and the stationary scroll member is detached from the upper frame 40. Then, a thin annular member 10 having a uniform thickness A' is put on the fitting surface 40*a* of the upper frame 40, and the stationary scroll member 1 is placed on the thin annular member 10 followed by fastening the stationary scroll member 1 and the upper frame 40 by the bolts 42. Thus, the minute gap A' is uniformly formed between the upper surface 6*a* of the element 6 of the oscillatable scroll member 2 and the bottom surface 102*a* of the base plate of the stationary scroll member 1. It goes without saying that the minute gap A' is also formed between the upper surface 6*a* of the element 6 of the stationary scroll member 1 and the bottom surface 202*a* of the base plate of the oscillatable scroll member 2.

Figure 13:
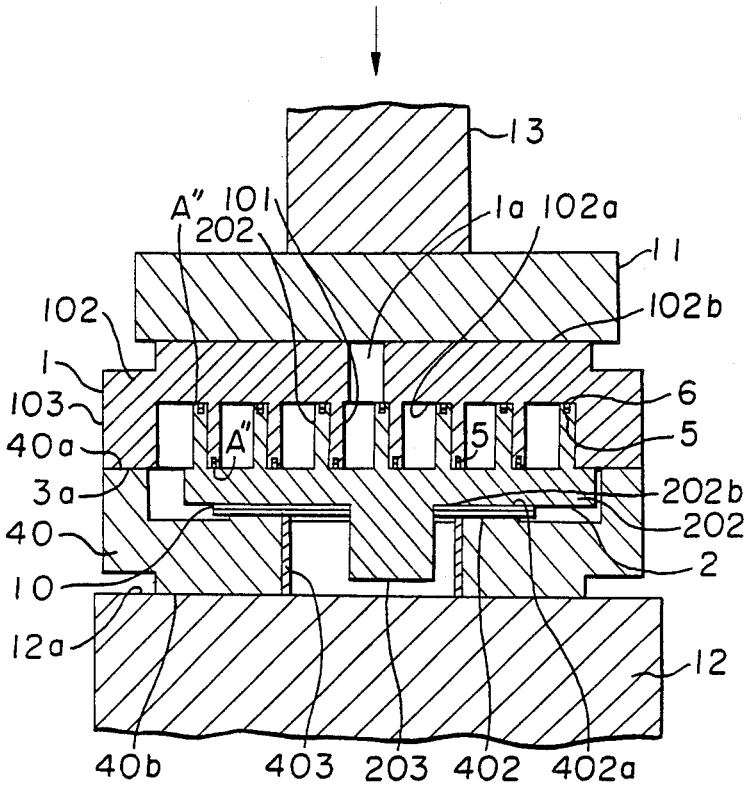
FIG. 13 shows another embodiment.

FIG. 13 shows another method for adjusting the gap A'. The element 6 is previously projected from each of the groove 5 in the end surface 101*a* or 201*a* to have a length greater than the predetermined minute gap A. Then, the upper frame 40 is put on a table 12 having a rigid surface 12*a* with the lower surface 40*b* of the frame 40 in contact with the surface 12*a*. Then, a thin annular member 10 having a uniform thickness A' and the same inner and outer diameter as the upper thrust bearing 402 is placed on the bearing surface 402*a* of the upper thrust bearing 402 which is fixed on the upper surface of the upper frame 40. On the thin annular member 10, the oscillatable scroll member 2 is mounted so that the thin annular member 10 is interposed between the rear surface 202*b* of the base plate of the oscillatable scroll member 2 and the thrust bearing 402. Then, the stationary scroll member 1 is assembled to the oscillatable scroll member 2 with their wrap plates 101, 201 being assembled with each other. Then, the upper surface 102*b* of the stationary scroll member 1 is pressed by a pressing arm 13 in the direction perpendicular to the surface 12*a* of the table 12. As a result, each of the elements 6 of the stationary and oscillatable scroll members 1, 2 is forcibly inserted in the groove 5 by the bottom surface 202*a* or 102*a* opposing each of the elements 6. The downward movement of the elements 6 is continued until the dimension A'', which is given by subtracting the thickness A' of the thin annular member 10 from the dimension of the predetermined gap A, is provided for the elements 6 projecting from the grooves 5. Thereafter, the assembly is disassembled to remove the thin annular member 10, and is reconstructed in the way as described with reference to FIG. 2. Thus, the minute gaps A' are uniformly formed between the upper surface 6*a* of each of the elements 6 and the bottom surface 102*a* or 202*a*.

Thus, a fine gap adjustment structure comprising combination of the groove 5 formed in the end surface of each of the wrap plates of the scroll members and the element 6 inserted in the groove provides a substantially gapless state between the end surfaces of the wrap plates and the bottom surfaces of the base plates opposing thereto, or minimum gaps between them so as so accommodate permissible error in the machining operation. Accordingly, leakage of the refrigerant gas which may occur in the radial direction of the wrap plates during the compressing operations can be suppressed. Further, there exist gaps between the side surfaces 6*b*, 6*c* of the element 6 and inner side surfaces 5*b* and 5*c* of the groove 5 thereby preventing leakage of the regrigerant gas from these parts.

Since the element 6 is forcibly fitted in the groove 5, the substantial pushing force of the element 6 to the bottom surface of the base plate is not produced. Accordingly, the wearing of the upper surface 6*a* of the element 6 does not take place in a normal operation of the compressor. Further, the fact that there is no pushing force against the bottom surface of the base plate means that there is no resistance of friction. Accordingly, smooth movement of the eccentric bush 301 can be obtained. Namely, the oscillating movement of the eccentric bush 301 causes smooth shift of the axial center of the oscillatable scroll member 2 fitted in the bush to the axial center of the main shaft 3. The oscillating movement is resulted by the centrifugal force of the oscillatable scroll member 2 itself.

However, when an excessive force is applied to the end surfaces 101*a*, 201*a* of the wrap plates of the stationary and oscillatable scroll members 1, 2, a resistance of friction is produced in these portions and an excessively large force is applied to the upper thrust bearing 402 which bears the oscillatable scroll member 2. As a result, the resistance of friction produced in the sliding section hinders the oscillatable scroll member 2 from moving in the direction such that the side surface of the wrap plate 201 of the oscillatable scroll member 2 is pushed to the side surface of the wrap plate 101 of the stationary scroll member 1 due to the oscillating movement of the eccentric bush 301. Accordingly, there are disadvantages that the movement of the oscillatable scroll member 2 is hindered; contact between the wrap plates is not properly provided, and leakage of the refrigerant gas increases at that portion to thereby invite deterioration of performance. When a load is further increased, there causes an accident of frictional heating of the upper thrust bearing 402.

In the above-mentioned embodiment, the upper thrust bearing 402 does not bear a substantial load since a pushing force to the bottom surfaces 102*a*, 202*a* is not substantially given by the upper surfaces 6*a* of the elements 6. Accordingly, smooth movement of the eccentric bush 301 can be obtained, and sealing effect between the wrap plates 101, 201 can be attained. Further, a pushing force which may be applied to the elements 6 by the bottom surfaces due to reduction in dimension of the gaps A caused by difference of thermal expansion of the wrap plates at the center of the scroll members during compressing operation can be absorbed by the movement of the elements 6 in the grooves 5 whereby the problem of frictional heating can be eliminated.

When the element 6 is formed by a material apt to cause plastical deformation, such as lead, solder and so on, there is another method of utilizing a nature apt to cause volume flow. An example of the method will be described with reference to FIGS. 14 and 15.

Figure 14:
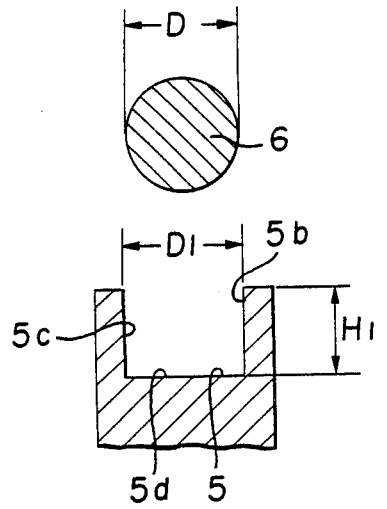
FIG. 14 is a cross-sectional view partly broken of another embodiment of the present invention.

FIG. 14 shows in cross-section the grooved wrap plate and the element 6 before assembling. In the Figure, the element 6 is made of a material easily causing plastical deformation such as lead or solder and has a circular shape in cross-section having a diameter D. The groove 5 for guiding the element 6 has a width D1 and a depth H1, where $D1 \geqq D$ and $H1 < D$. Because of $D1 \geqq D$, the element 6 is easily fitted into the guide groove 5 in assembling work.

Figure 15:
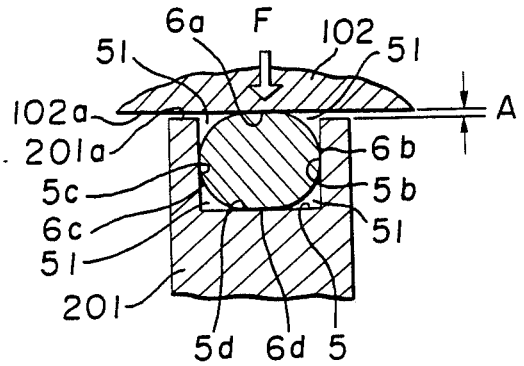
FIG. 15 is a cross-sectional view partly broken of an important part in a assembled state of the present invention.

FIG. 15 shows an assembled state. The element 6 fitted in the guide groove by using the methods described with reference to FIG. 12 or 13 is subjected to plastical deformation by the bottom surface 102*a* in the direction of an arrow mark F. In this case, the volume flow in the plastical deformation takes place in spaces 51 at four corners which are formed by the element 6, the guide groove 5 and the bottom surface 102*a* of the base plate; thus, the plastical deformation of the element 6 is easy. As a result, the element 6 is deformed to have four flat surfaces 6*a*, 6*b*, 6*c*, 6*d* in cross-section so as to be in close-contact with the corresponding bottom surface 102*a*, the both side surfaces 5*b* 5*c* and the bottom surface 5*d* of the guide groove while a proper gap A is remained between the end surface 201*a* and the bottom surface 102*a*.

Thus, by using the above-mentioned expedient, sealing between the end surface of the wrap plate and the bottom surface of the base plate in the axial direction can be established, and an abnormal force in the axial direction which is caused by the element 6 due to plastical deformation, wearing and so on can be avoided.

As described above, in the above-mentioned embodiment of the present invention, the element is forcibly fitted in the groove formed in the end surface of the wrap plate of each of the scroll members by utilizing its nature of plastical deformation, so that the gap formed in the axial direction between the end surface and the bottom surface of the base plate can be finely adjusted. Accordingly, errors in dimension in machining operation of the stationary and scroll members can be accommodated, and fine adjustment to give a requisite minimum fine gap can be made. Further, even when the element comes in contact with the base plate due to thermal deformation, there causes further plastical deformation or wearing of the element to assure an stable operation of the machine. Thus, a fine gap adjustment structure for the scroll-type fluid transferring machine having high reliability can be provided.

When the scroll-type fluid transferring machine in which the elements 6 are properly fitted in the grooves 5 is operated for a long term, there may be a problem that a local part of the element 6 abnormally wears or the element 6 falls in the groove 5.

Figure 16:
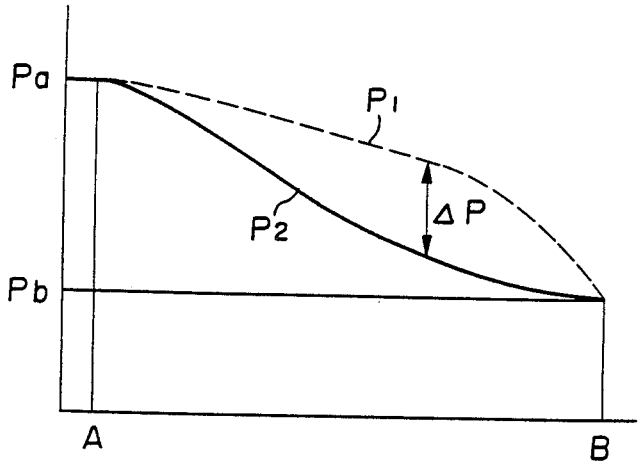
FIG. 16(*a*) and 16(*b*) are diagrams showing characteristic curves of a conventional scroll-type fluid transferring machine, wherein P2<P1 in FIG. 16(*a*) and p2>P1 in FIG. 16(*b*)
Figure 16:
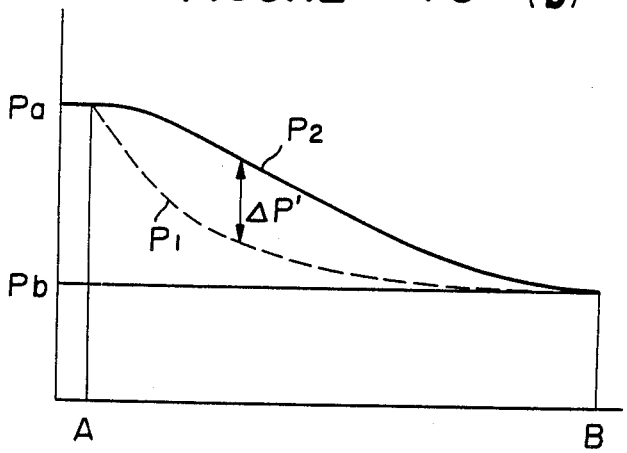

The inventors measured pressures in the air gap 501 shown in FIG. 10 and the compression chamber P during the operation of the machine, and obtained results as in FIG. 16(*a*) and 16(*b*).

In FIG. 16, a curve Pl shows variation in pressure in the air gap 501 from a time point B to a time point A and a curve P2 shows variation in pressure in the compression chamber P in a period corresponding to the curve Pl, wherein Δ P indicates difference of pressure between Pl and P2. Although the result shown in FIG. 16 is variable depending on the condition of operation and selection of time points, there is a case that the pressure Pl in the air gap 501 is greater than the pressure P2 in the compression chamber P by Δ P as shown in FIG. 16*a*. In this case, the element 6 is excessively projected from the groove 5 so that there takes place wearing of the element 6 by relative frictional movement to the base plate 102 or 202. On the other hand, when Pl is smaller than P2 by Δ P, the element 6 is excessively retracted in the groove 5. In view the fact, the inventors have had an idea of forming a communicating portion between the compression chamber P and the air gap 501 to equalize pressure.

Figure 17:
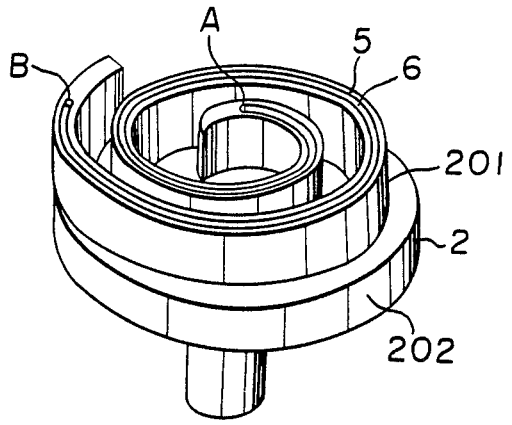
FIG. 17 is a perspective view of the oscillatable scroll member according to the present invention.

FIG. 17 shows an example of equalization of a pressure by forming the communicating port. In FIG. 17, the gap at the beginning part A and the ending part B of the element 6 in the groove 5 is more or less windened. As a result, a pressure different Δ P between Pl and P2 becomes small as shown in the diagram of FIG. 18.

Figure 18:
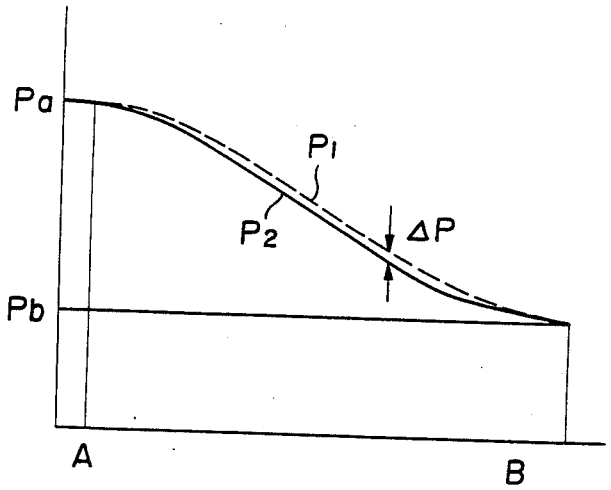
FIG. 18 is a diagram showing a characteristic curves according to the present invention.
Figure 19:
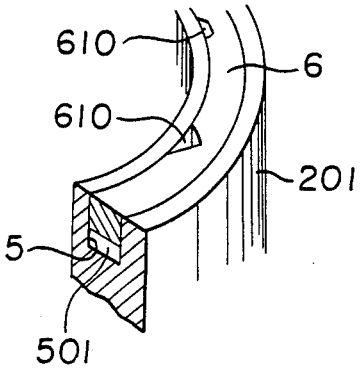
FIGS. 19 to 25 are respectively diagrams showing other embodiments of the present invention.
Figure 20:
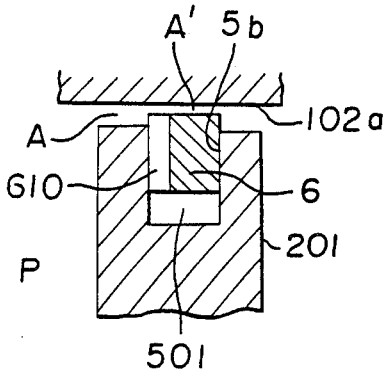

In further development of the idea, an attempt such that the air gap 501 is communicated with the compression chamber P at points along the longitudinal direction of the wrap plate by forming a plurality of recesses 610 in the element 6 as shown in FIGS. 19 and 20 results in further reduction in the value of Δ P to attain further pressure equalization as shown in FIG. 18. A long term operation of the scroll machine with the construction as shown in FIGS. 19 and 20 did not cause the wearing or falling of the element 6.

Figure 21:
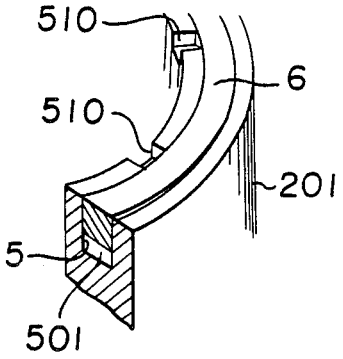
Figure 22:
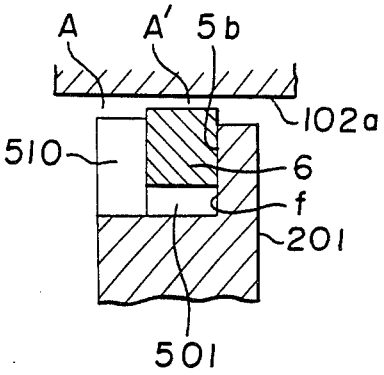

The pressure equalizing recesses may be provided in the groove 5. FIGS. 21 and 22 show such expedient in which a plurality of pressure equalizing recesses are formed in the groove 5 at points along the longitudinal direction of the wrap plate.

Figure 23:
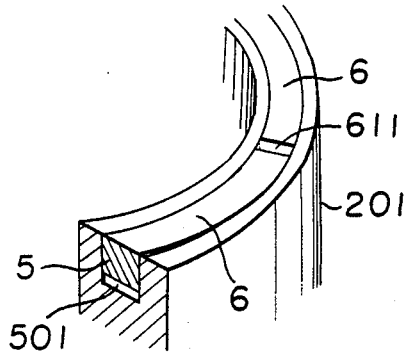
Figure 24:
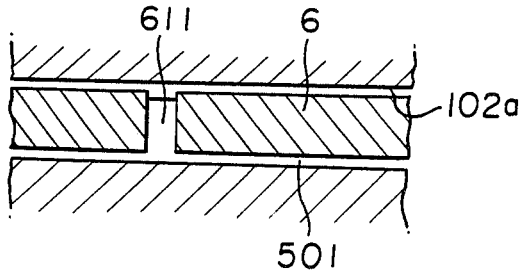
Figure 25:
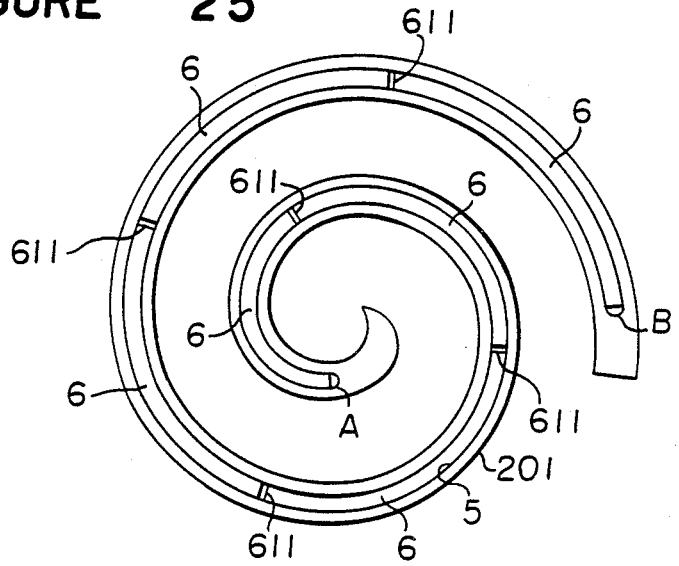

FIGS. 23 to 25 show still another embodiment. The element 6 is divided into plural pieces along the longitudinal direction of the wrap plate, a gap or space 611 is formed between each divided elements 6. With such construction, a piece of the element 6 can be shortened whereby processability is improved.

Figure 26:
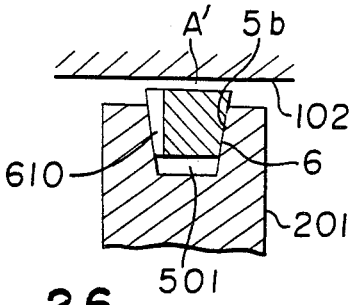
FIG. 26(*a*) through 26(*c*) respectively show different embodiments of the groove shape.

FIG. 26(*a*) through 26(*c*) show modified embodiments of the combination of the element 6 and the groove 5 which aim at stable fitness between the element and the groove as well as prevention of the element from movement in the groove. Namely, as shown in FIG. 26*a*, the groove 5 is formed in a tapered shape in cross-section so that the element 6 does not sink beyond a predetermined level. In FIG. 26*b*, the groove 5 is formed to have a tapered shape which is inversed to the FIG. 6*a* so that wearing caused by sliding movement between the element 6 and the base plate 102 caused when the element 6 projects upward can be prevented. In FIG. 26*c*, projections 512 are formed at both side surfaces of the groove 5 to physically fix the element 6.

Thus, the air gap is provided between the element and the lower part of the groove, and the air gap is communicated with the compression chamber to thereby equalize a pressure between the air gap and the compression chamber. Accordingly, movement of the element in the axial direction due to change in a pressure in the compression chamber can be prevented. With such construction, a substantial amount of force is produced in the elements in their axial directions and there is no resistance of friction and wearing between the elements and base plates. Further, falling of the elements in the bottom part of the grooves is prevented. Thus, a highly reliable fine gap adjustment structure for the scroll-type fluid transferring machine which provides a stable operation and free from leakage of the refrigerant gas can be provided.

Figure 27:
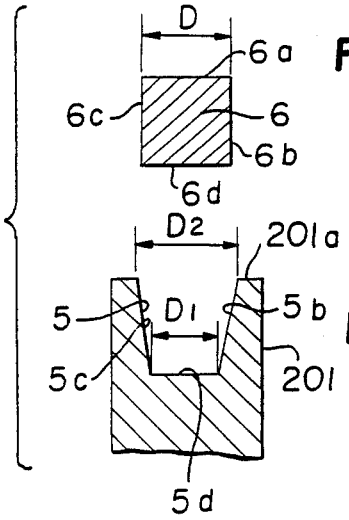
FIG. 27 is a cross-sectional view showing another embodiment of the present invention.
Figure 26:
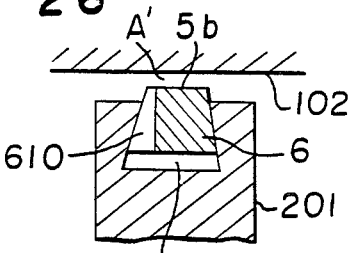
Figure 26:
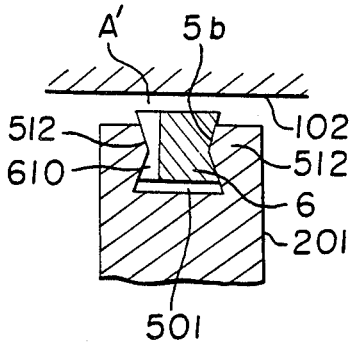

FIG. 27 shows a mofidication of the element 6 and the guide groove 5 which improve easiness in inserting the element 6 into the groove 5 in the assembling operation and suppress production of burrs in the both side surfaces of the element 6. Namely, the guide groove 5 is formed to have tapered side surfaces 5*b*, 5*c* so that the width D2 at the opening part of the groove is greater than the width D1 at the bottom surface 5d. In other words, easiness of insertion of the element 6 in the guide groove 5 is improved by giving a relation $D1<D<D2$, where D is the width of the element 6.

Figure 28:
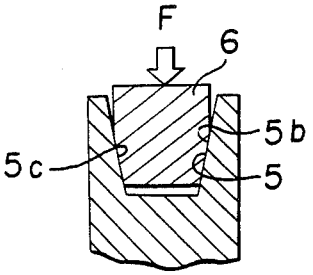
FIG. 28(*a*) corresponds to FIG. 27 but shows the element fitted in the groove.
Figure 28:
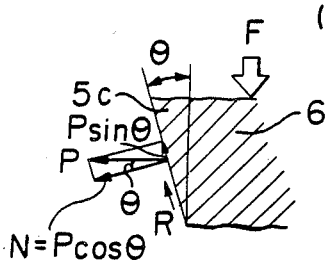
Figure 30:
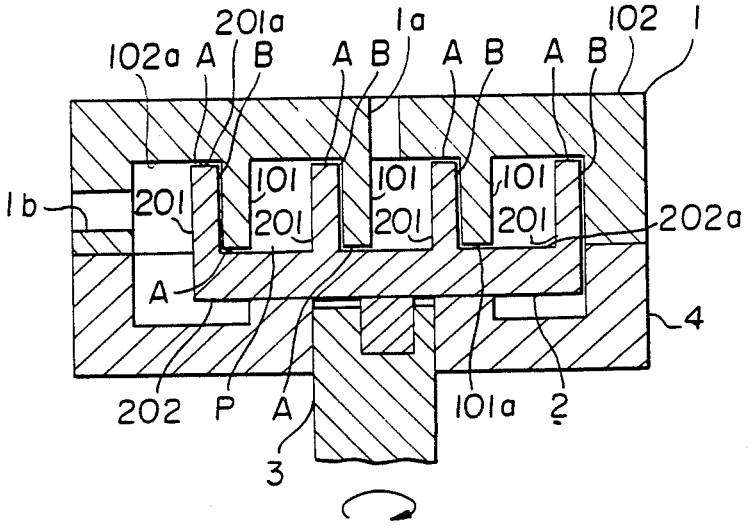
FIGURE 30 PRIOR ART
FIG. 30 is a cross-sectional view of an important part of a conventional scroll-type fluid transferring machine.
Figure 31:
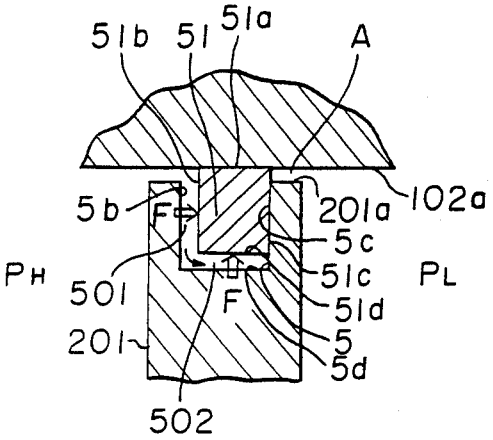
FIGURE 31 PRIOR ART
FIGS. 31 to 34 are respectively cross-sectional views partly broken of the conventional machine.
Figure 32:
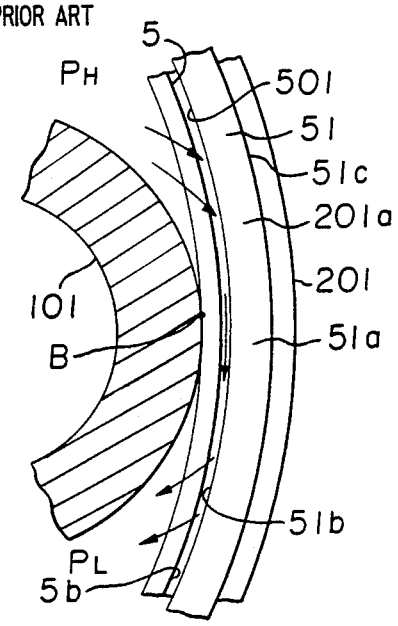
FIGURE 32 PRIOR ART
Figure 33:
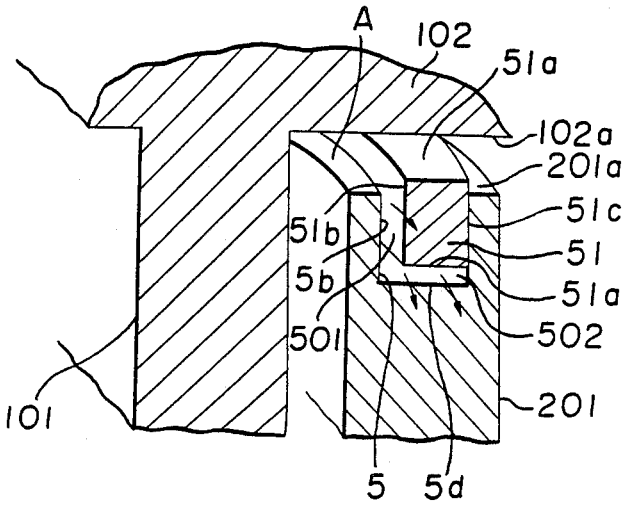
FIGURE 33 PRIOR ART
Figure 34:
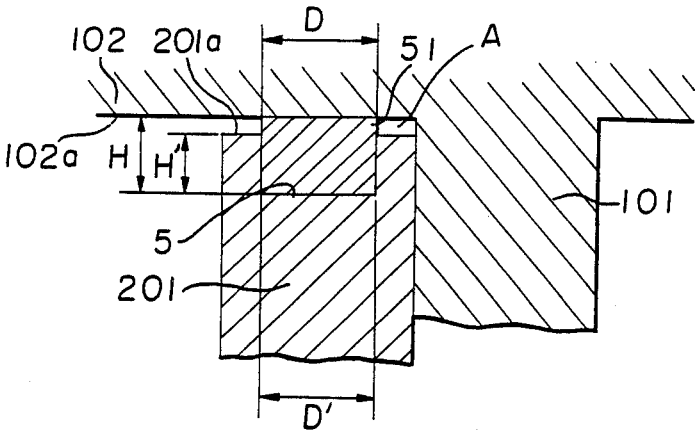
FIGURE 34 PRIOR ART

FIG. 28*a* shows the element 6 fitted in the groove 5 having the construction as in FIG. 27. The both side surfaces at the lower portion of the element 6 is deformed by the tapered side surfaces 5*b*, 5*c* of the groove 5. For the element 6, a material having resiliency such as polyethylene tetrafluoride is preferably used. Balance of forces between the element 6 and the groove 5 is expressed as follows.

In FIG. 28*b*, $$\begin{aligned} F &= 2P\sin\theta\cos\theta + 2R\cos\theta \\ &= 2P\cos\theta(\sin\theta + \mu\cos\theta) \end{aligned}$$

where $\theta$ is an angle either one of the tapered side surfaces 5*b*, 5*c* of the groove 5, P is a stress of compression of the element 6 forcibly inserted in the groove 5, F is a depressing force to the element 6 in the axial direction, R is a force of friction which is produced when the elment 6 slides on the side surface 5*c* of the groove 5 against a depressing force F, and $\mu$ is a frictional coefficient of the element 6.

In the equations, when the value of the left side is greater than the value of the right side, the element 6 falls into the bottom of the groove. Accordingly, the value $\theta$ is so determined that the value of the left side is smaller than or equal to the value of the right side. When the left side < the right side, lifting-up of the element 6 is expected. However, in this case, the element 6 is brought to close-contact with the corresponding bottom surface 101*a* or 201*a*, whereby further sealing effect can be provided.

Thus, the guide groove is formed to have an inverse trapezoidal form. Accordingly, the movement of the element in the axial direction due to variation in pressure in the compression chambers can be prevented, and the element 6 is free from falling in the bottom part of the guide groove.

What is claimed is:

1. A scroll-type fluid transferring machine having stationary and oscillatable scroll members, each being provided with a base plate and a wrap plate projecting from a surface of said base plate, which are combined in such a manner that a plurality of compression chambers are formed by the surface of said base plates and wrap plates and a fluid contained in said chambers is transferred, compressed or expanded by the revolution of said oscillatable scroll member, comprising:

a first fine adjustment element having the same spiral form as the wrap plate of said stationary scroll member;

a second fine adjustment element having the same spiral form as the wrap plate of said oscillatable scroll member;

a first guide groove having the same spiral form as, and a width no greater than, said first fine adjustment element and being formed in the top end surface of the wrap plate of said stationary scroll member;

a second guide groove having the same spiral form as, and a width no greater than, the second fine adjustment element and being formed in the top end surface of the wrap plate of said oscillatable scroll member, wherein said first and second fine adjustment elements are respectively received in said first and second guide grooves with an air gap between each of said fine adjustment elements and a bottom of a respective one of said grooves; and means for fluidically communicating said air gap with said compression chambers, so that the fluid in said compression chamber may flow into said air gap and the gaps between the end surface of the wrap plates and the surface of said base plates facing said wrap plates are accurately maintained.

wherein said means for communicating comprise at least one of said fine adjusting elements being formed of a plural number of pieces spaced along the length of a respective one of said guide grooves to define a space between two adjacent ones of said plural pieces, wherein said one of said guide grooves is continuous at said space.

2. The scroll-type fluid transferring machine of claim 1 wherein both of said fine adjusting elements are formed of said plural number of pieces.

* * * * *